US011542928B2

(12) United States Patent
Surjaatmadja et al.

(10) Patent No.: US 11,542,928 B2
(45) Date of Patent: Jan. 3, 2023

(54) MODULAR PUMPING SYSTEM

(71) Applicant: HALLIBURTON ENERGY SERVICES, INC., Houston, TX (US)

(72) Inventors: Jim B. Surjaatmadja, Duncan, OK (US); Timothy H. Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 16/475,708

(22) PCT Filed: Feb. 23, 2017

(86) PCT No.: PCT/US2017/019034
§ 371 (c)(1),
(2) Date: Jul. 3, 2019

(87) PCT Pub. No.: WO2018/156131
PCT Pub. Date: Aug. 30, 2018

(65) Prior Publication Data

US 2019/0345920 A1 Nov. 14, 2019

(51) Int. Cl.
*F04B 15/02* (2006.01)
*F04B 17/03* (2006.01)
(Continued)

(52) U.S. Cl.
CPC ..... *F04B 15/02* (2013.01); *F04B 17/03* (2013.01); *F04B 23/04* (2013.01); *F04B 53/16* (2013.01);
(Continued)

(58) Field of Classification Search
CPC ..... F04B 15/02; F04B 17/03; F04B 23/04; F04B 53/16; F04B 47/02; F04D 13/14;
(Continued)

(56) References Cited

U.S. PATENT DOCUMENTS 3,138,113 A 6/1964 Arutunoff
5,494,403 A * 2/1996 Kobayashi ..... H02K 9/16 415/102
(Continued)

FOREIGN PATENT DOCUMENTS

JP 2007298219 A1 8/2007
WO 2015183600 A1 12/2015
WO 2016100254 A1 6/2016

OTHER PUBLICATIONS

Argonne National Laboratory Evaluation of Pressure Rating Methods study, evaluation-of-pressure-rating-methods-recommended-by-api-rp-17tr8 pdf (Year: 2017).*
(Continued)

*Primary Examiner* — Kenneth J Hansen
*Assistant Examiner* — David N Brandt
(74) *Attorney, Agent, or Firm* — K&L Gates LLP

(57) ABSTRACT

A pumping module is positionable within a pump housing for pumping fluid into a wellbore. The pumping module includes a cylindrical housing with an inlet end and an outlet end, an inlet cap positioned on the inlet end of the cylindrical housing and including an inlet formed through the inlet cap, and an outlet cap positioned on the outlet end of the cylindrical housing and including an outlet formed through the outlet cap. A shaft is rotatable with respect to the cylindrical housing, and a rotor is positioned within the cylindrical housing and rotatable by the shaft to push fluid through the cylindrical housing.

11 Claims, 5 Drawing Sheets

(51) Int. Cl.

| | |
|---|---|
| ***F04B 23/04*** | (2006.01) |
| ***F04B 53/16*** | (2006.01) |
| ***F04D 13/10*** | (2006.01) |
| ***F04D 29/62*** | (2006.01) |
| ***F04D 7/04*** | (2006.01) |
| ***F04D 13/14*** | (2006.01) |
| ***F04D 29/048*** | (2006.01) |
| ***F04D 25/16*** | (2006.01) |
| ***F04D 13/02*** | (2006.01) |
| ***F04D 29/26*** | (2006.01) |
| ***F04D 25/02*** | (2006.01) |

(52) U.S. Cl.
CPC ..... *F04D 7/04* (2013.01); *F04D 13/10* (2013.01); *F04D 13/14* (2013.01); *F04D 29/048* (2013.01); *F04D 29/628* (2013.01); *F04D 13/024* (2013.01); *F04D 25/026* (2013.01); *F04D 25/16* (2013.01); *F04D 29/266* (2013.01)

(58) Field of Classification Search
CPC ..... F04D 29/048; F04D 7/04; F04D 29/628; F04D 25/16; F04D 29/186; F04D 13/024; F04D 29/263; F04D 29/266; F04D 25/026
See application file for complete search history.

(56) References Cited

U.S. PATENT DOCUMENTS

| | | | | |
|---|---|---|---|---|
| 5,842,520 | A | 12/1998 | Bolin | |
| 5,909,098 | A | 6/1999 | Konecny et al. | |
| 6,554,584 | B2 * | 4/2003 | Takura | F04D 3/02 241/46.11 |
| 8,336,631 | B2 | 12/2012 | Shampine et al. | |
| 8,851,186 | B2 | 10/2014 | Shampine et al. | |
| 9,016,383 | B2 | 4/2015 | Shampine et al. | |
| 2002/0066568 | A1 | 6/2002 | Buchanan et al. | |
| 2003/0049143 | A1 * | 3/2003 | Takura | F04D 3/00 417/423.5 |
| 2004/0050073 | A1 * | 3/2004 | Lyons | F04B 37/08 62/50.1 |
| 2007/0059166 | A1 | 3/2007 | Sheth et al. | |
| 2008/0105316 | A1 | 5/2008 | Serafin et al. | |
| 2016/0215774 | A1 * | 7/2016 | Oklejas | E21B 43/26 |

OTHER PUBLICATIONS

International Search Report and Written Opinion dated Nov. 14, 2017 for PCT Application PCT/US2017/019034 filed Feb. 23, 2017 (16 pages).

* cited by examiner

MODULAR PUMPING SYSTEM

BACKGROUND

This section is intended to provide relevant background information to facilitate a better understanding of the various aspects of the described embodiments. Accordingly, it should be understood that these statements are to be read in this light and not as admissions of prior art.

In special oilfield applications, pump assemblies are used to pump a fluid from the surface into a wellbore at high pressures. Such applications may include hydraulic fracturing, cementing, and pumping through coiled tubing, among other applications. In the example of a hydraulic fracturing operation, a multi-pump assembly is often employed to direct an abrasive containing fluid, or fracturing fluid, through a wellbore and into targeted regions of the wellbore to create side "fractures" in the wellbore. To create such fractures, the fracturing fluid is pumped at extremely high pressures, sometimes in the range of 10,000 to 15,000 psi (68,900 kPA to 103,400 kPA) or more. In addition, the fracturing fluid contains an abrasive proppant which both facilitates an initial creation of the fracture and serves to keep the fracture "propped" open after the creation of the fracture. These fractures provide additional pathways for underground oil and gas deposits to flow from underground formations to the surface of the well. These additional pathways serve to enhance the production of the well.

However, the abrasive nature of fracturing fluids, or other fluids for that matter that are pumped downhole (e.g., cement), is not only effective in breaking up underground rock formations to create fractures therein, it also tends to wear out the internal components of the pumps that are used to pump it. Thus, when pumps are used to pump fluid (and any particulate or other solids carried by the fluid) downhole, the repair, replacement and/or maintenance expenses for the internal components of the pumps can be high, while the overall life expectancy of the pumps can be low.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
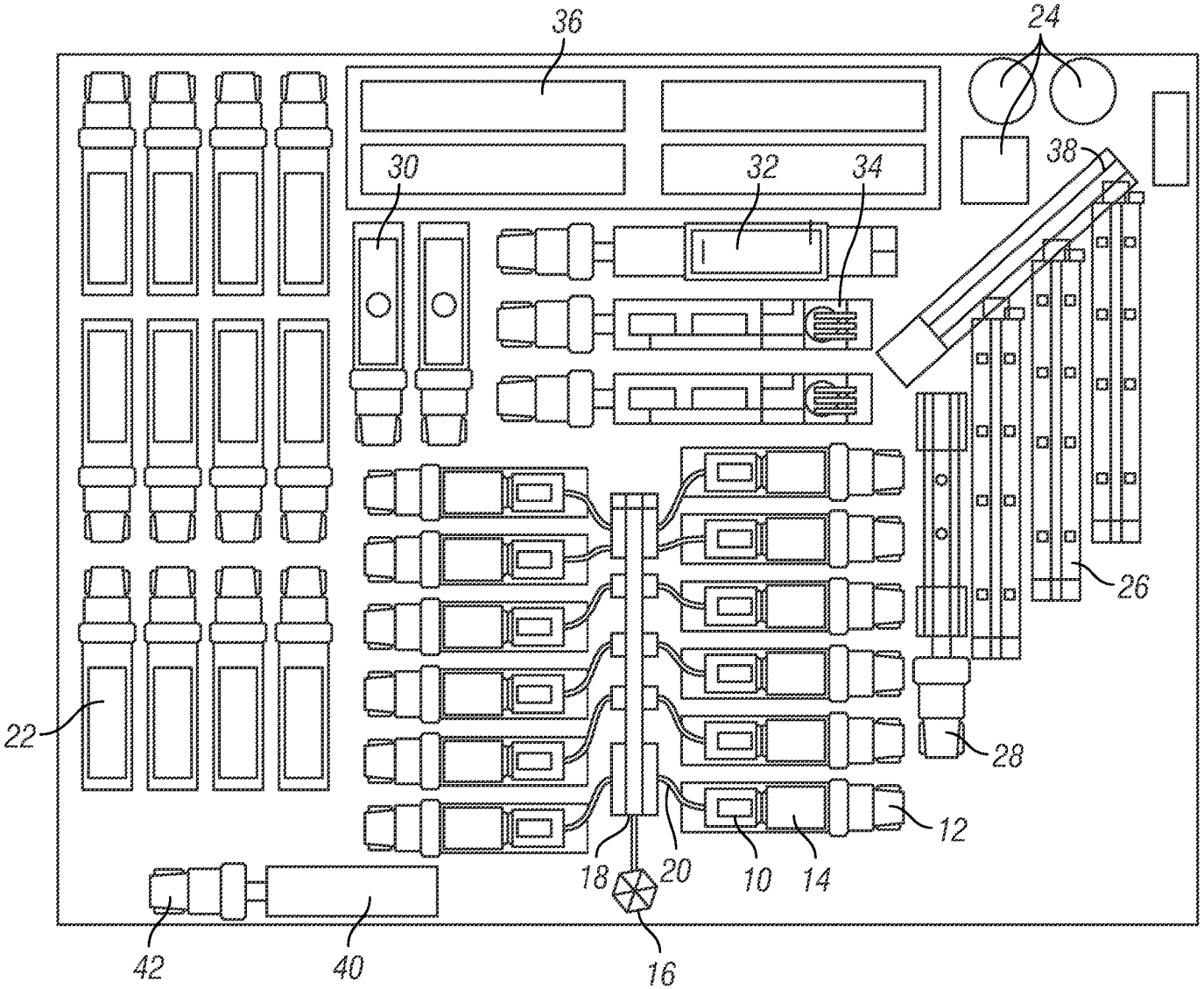
FIG. 1 depicts a plan view of an example pumping system, according to one or more embodiments.

Referring now to the figures, FIG. 1 depicts one or more embodiments of a system used in a fluid pumping operation, such as hydraulic fracturing and/or cementing a wellbore. Specifically, the system includes a plurality of pumps 10 mounted to vehicles 12, such as trailers of the vehicles 12. In the embodiment shown, the pumps 10 are powered by electric motors 14, in which the motors 14 may also be mounted to the vehicles 12. The pumps 10 are fluidly connected to a wellhead 16 through a manifold 18. As shown, the vehicles 12 may be positioned near enough to the manifold 18 to connect fracturing fluid lines 20 between the pumps 10 and the manifold 18. The manifold 18 may then be connected to the wellhead 16 to deliver fracturing fluid from the pumps 10 to the wellhead 16.

Figure 2:
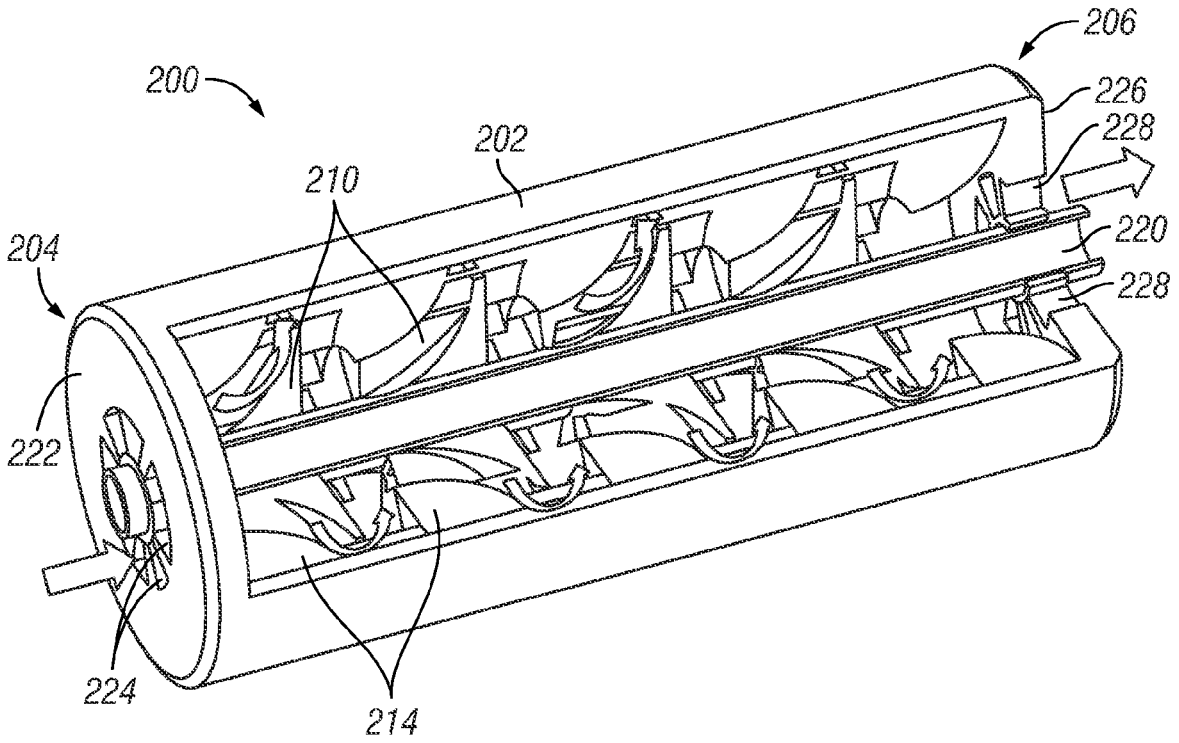
FIG. 2 depicts a sectioned perspective view of an example pumping module, according to one or more embodiments.
Figure 3:
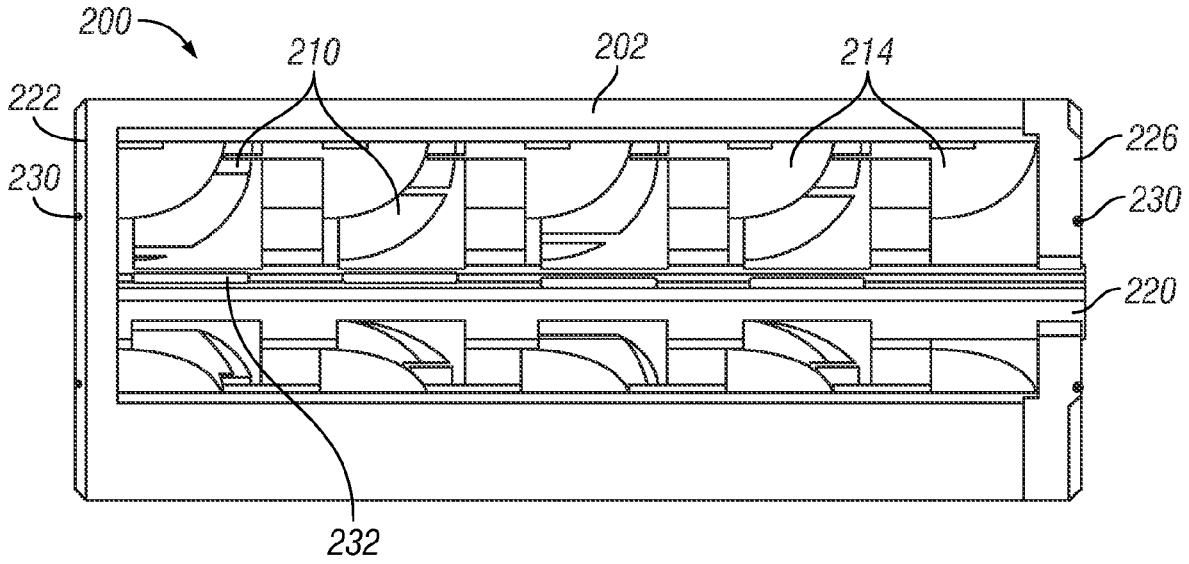
FIG. 3 depicts another sectioned perspective view of an example pumping module, according to one or more embodiments.

FIGS. 2 and 3 depict one or more embodiments of a pumping module 200 that may be used to pump fluid, such as in the system shown in FIG. 1. Though described more below, one or more pumping modules 200 may be positioned within a pump (e.g., positioned within a pump housing, discussed more below) to work in conjunction with each other when pumping fluid. The pumping module 200 includes a housing 202 having a generally cylindrical shape with ends 204 and 206 formed on opposite sides of the housing 202. For convenience, in this embodiment the end 204 will be referred to as the inlet end, and the end 206 will be referred to as the outlet end, as fluid is shown flowing into the inlet end 204, through the housing 202, and out through the outlet end 206. However, the present disclosure is not so limited, as fluid may flow in either direction through the pumping module 200.

One or more rotors 210 and one or more stators 214 are positioned within the housing 202. In particular, as the pumping module 200 may be a multi-stage pumping module in this embodiment, multiple rotors 210 and stators 214 may be paired together and positioned within the pumping module housing 202 (e.g., in series) with each pair forming a stage within the pumping module 200. The rotors 210 may be arranged within the pumping module 200 such that the rotors 210 are rotatable with respect to the stators 214. For example, the stators 214 may be rotatably fixed with respect to the housing 202, such as by including an anti-rotation feature between the stators 214 and the housing 202. This anti-rotation feature may include a pin, bolt, screw, or any other suitable device extending between the housing 202 and the stators 214 to prevent rotation, or a slot and groove engagement between the housing 202 and the stators 214 to prevent rotation. Alternatively, the stators 214 may be integrally formed with the housing 202. The rotors 210 may rotate with respect to the housing 202, such as about an axis of the cylindrical housing 202, to rotate with respect to the stators 214. The rotation of the rotors 210 with respect to the housing 202 and the stators 214 may push fluid through the housing 202, such as from the inlet end 204 to the outlet end 206, depending on the direction of rotation of the rotors 210.

A shaft 220 is included with the pumping module 200 to impart rotation to the rotors 210. The shaft 220 is rotatable with respect to the housing 202, and in this embodiment, may be at least partially positioned within and extending into or through the housing 202. The rotors 210 are coupled to the shaft 220 such that, as the shaft 220 rotates, the rotors 210 will also rotate. For example, the rotors 210 may be magnetically coupled to the shaft 220, such as by including magnets within the rotors 210 and/or the shaft 220 such as magnets 232. This arrangement may enable the shaft 220 to impart rotation to the rotors 210 through magnetic forces occurring between the rotors 210 and the shaft 220. Alternatively, the rotors 210 may be rotationally fixed to the shaft 220, such as by including an anti-rotation feature between the rotors 210 and the shaft 220 or by having the rotors 210 integrally formed with the housing 202. The shaft 220 may also be placed in a sealed system, isolated from the fluid, with magnetic connections through a non-magnetic wall (not shown).

Referring still to FIGS. 2 and 3, the pumping module 200 may include one or more caps 222 and 226, such as to secure the rotors 210 and stators 214 within the housing 202 and/or the shaft 220 to the housing 202. As shown, an inlet cap 222 may be positioned on the inlet end 204 of the housing 202, and an outlet cap 226 may be positioned on the outlet end 206 of the housing 202. One or more inlets 224 or ports may be formed within the inlet cap 222 to enable fluid to flow into the housing 202, and one or more outlets 228 or ports may be formed within the outlet cap 226 to enable fluid to flow out of the housing 202. Further, the shaft 220 may extend through one or both of the caps 222 and 226 to position the shaft 220 within the housing 202, such as along the axis of the housing 202.

One or both of the caps 222 and 226 may be integrally formed with the housing 202 and/or removable from the housing 202. For example, as shown in FIG. 3 specifically, the inlet cap 222 may be integrally formed with the housing 202, while the outlet cap 226 may be removable from the housing 202, such as by having the outlet cap 226 threadedly coupled with the housing 202. By having the outlet cap 226 removable from the housing 202, the rotors 210 and/or stators 214 may be removed from or inserted into the housing 202 through the outlet end 206 when the outlet cap 226 is removed. This may facilitate assembly and maintenance of the pumping module 200. Another option is that the caps 222 and 226 may be slidingly coupled with the housing 202. The caps may also be installed to be non-rotational with respect to the housing 202, and positioned such that the cap openings 224, 228 stay aligned with each other to prevent flow blockages through the housings 202.

The pumping module 200 may further include one or more seals, particularly as one or more pumping modules 200 may be positioned together within a larger housing of pump to work in conjunction with each other to pump fluid. For example, as shown in FIG. 3, a seal 230 may be positioned on the inlet cap 222 and/or the outlet cap 226. The seal 230 positioned on the inlet cap 222 may be positioned about the inlets 224, such as within a groove formed about the inlets 224, and the seal 230 positioned on the outlet cap 226 may be positioned about the outlets 228, such as within a groove formed about the outlets 228. The seals 230 may be used to form a seal between adjacent pumping modules 220, such as when compressed against each other within a pump housing.

Figure 4A:
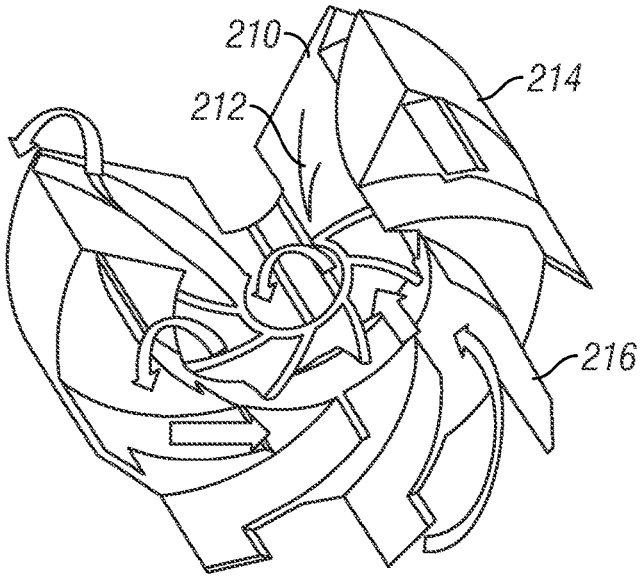
FIGS. 4A-4C depict perspective views of an example rotor and stator included within a pumping module, according to one or more embodiments.
Figure 4B:
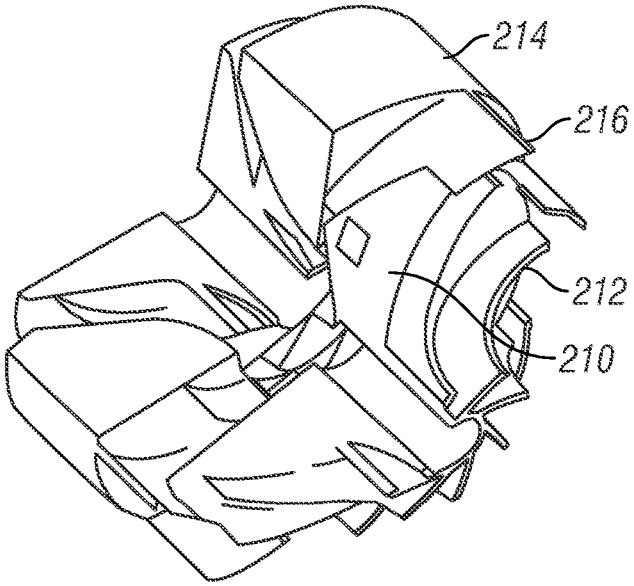
Figure 4C:
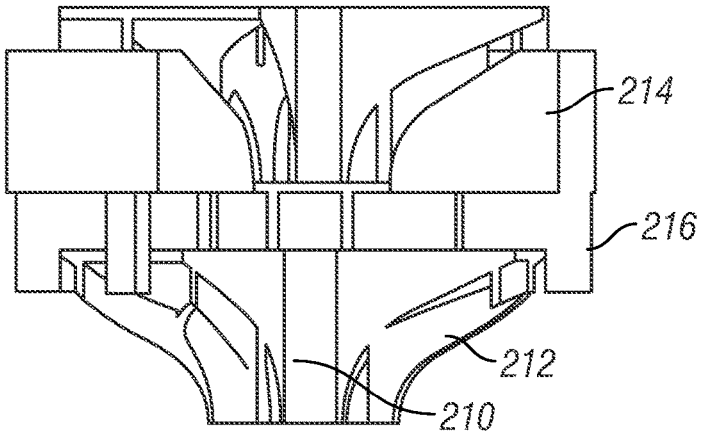

As shown above, a pumping module 200 may include more than one rotor 210 and stator 214 to form multiple stages within the pumping module 200. However, the present disclosure may not be so limited, and instead may only include one rotor 210 and one stator 214. Accordingly, in the embodiment shown above, the pumping module 200 may be a multi-stage centrifugal pump. In such an embodiment, and as shown in FIGS. 4A-4C, the rotor 210 may include one or more rotor fins 212 to define rotor fluid channels within the rotor 210, and the stator 214 may include one or more stator fins 216 to define stator fluid channels within the stator 214. In this embodiment, as the rotor 210 rotates in a counterclockwise direction, the fins 212 and channels of the rotor 210 will push fluid radially outward and partially in the counterclockwise direction. This fluid will then be captured by the fins 216 and channels of the stator 214 to direct the fluid radially inwards and towards the next stage or rotor 210 with the housing 202 of the pumping module 200. Further, though only a multistage centrifugal pump is shown for the pumping module 200 in FIGS. 2-4C, the present disclosure is not so limited, as the pumping module 200 may include a positive displacement pump, a progressive cavity pump, other velocity pumps, in addition to other types of pumps.

Figure 5:
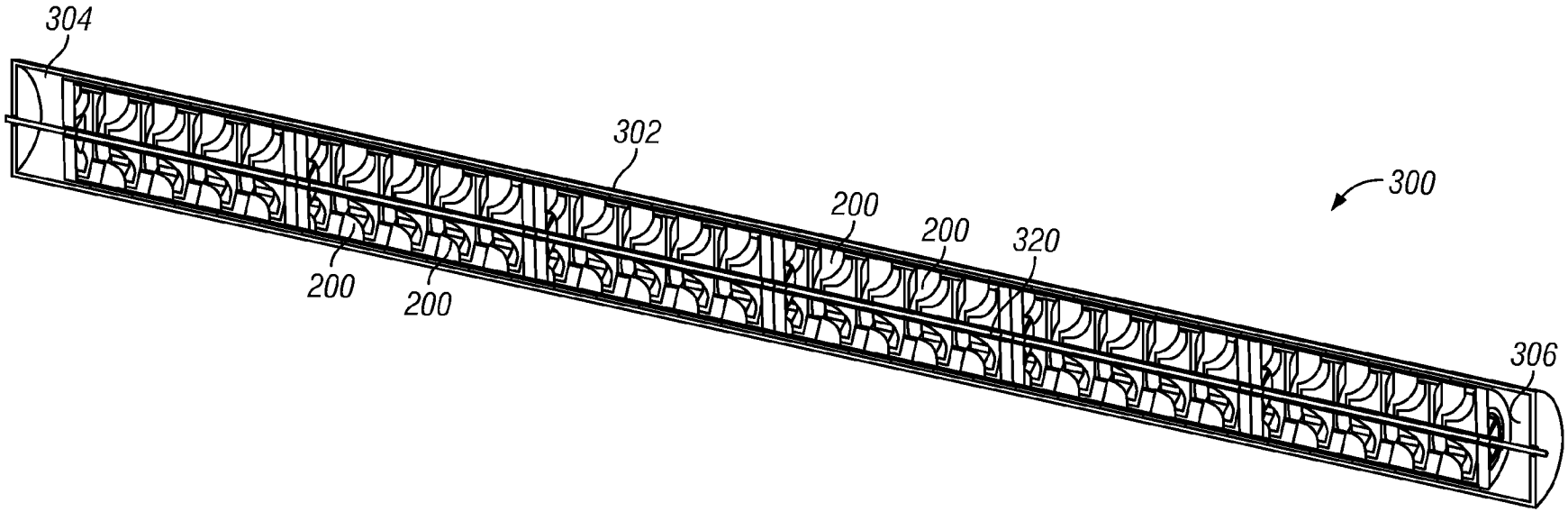
FIG. 5 depicts a sectioned perspective view of an example pump, according to one or more embodiments.

FIG. 5 depicts one or more embodiments of a pump 300 that may be used to pump fluid, such as in the system shown in FIG. 1. The pump 300 includes a housing 302 having a generally cylindrical shape with ends 304 and 306 formed on opposite sides of the housing 302. As with the pumping module 200 described above, for convenience the end 304 will be referred to as the inlet end, and the end 306 will be referred to as the outlet end, as fluid may flow into the inlet end 304, through the housing 302, and out through the outlet end 306. However, the present disclosure is not so limited, as fluid may flow in either direction through the pump 300.

One or more pumping modules 200 are positioned within the housing 302 of the pump 300 to work in conjunction with each other when pumping fluid. The pumping modules 200 may be rotatably fixed with respect to the housing 302, such as by including an anti-rotation feature between the pumping modules 200 and the housing 302. For example, a pumping module 200 may include a male member engageable with a female member of the housing 302 (e.g., a pin engageable with a slot), or vice-versa, to prevent rotation between the pumping module 200 and the housing 302. The pumping modules 200 are positioned such that fluid may be pumped from the outlet of one pumping module 200 to the inlet of the adjacent pumping module 200 within the housing 302.

A shaft 320 is included within the pump 300 and is rotatable with respect to the housing 302 to rotate the rotors of the pumping modules 200. The shaft 320 is rotatable with respect to the housing 302 may be at least partially positioned within and extending into or through the housing 302. Further, the shaft 320 may extend through each of the pumping modules 200. Alternatively, the shaft 320 may be segmented and formed from multiple individual shafts, such as the shaft 220 for the pumping modules 200 in FIGS. 2 and 3. In such an embodiment, the shafts 220 of each of the pumping modules 200 may be coupled to each other and rotationally fixed with respect to each other to rotate in unison and form the shaft 320 for the pump 300. A motor is coupled to the shaft 320 to impart rotation to the shaft 320 and rotate the rotors of the pumping modules 200 with respect to the housing 302 of the pump.

As with the pumping module 200 shown in FIGS. 2 and 3, the pump 300 may include one or more caps 322 and 326, such as to secure the pumping modules 200 within the housing 302 and/or the shaft 320 to the housing 302. As shown, an inlet cap 322 may be positioned on the inlet end 304 of the housing 302, and an outlet cap 326 may be positioned on the outlet end 306 of the housing 302. One or more inlets or ports may be formed at or near the inlet end 304 to enable fluid to flow into the housing 302, and one or more outlets or ports may be formed at or near that outlet end 306 to enable fluid to flow out of the housing 302. Further, the shaft 220 may extend through one or both of the caps 322 and 326 to position the shaft 320 within the housing 302, such as along the axis of the housing 302. The caps 322 and 326 may be integrally formed with the housing 302 and/or removable from the housing 302. By having one or both of the caps 322 and 326 removable from the housing 302, the pumping modules 200 may be removed from or inserted into the housing 302 through an end of the housing when the respective cap is removed. This may facilitate assembly and maintenance of the pump 300.

In one or more embodiments, the housing 302 of the pump 300 may provide structural support to the housings 202 of the pumping modules 200. For example, the housing 302 of the pump 300 may have a higher pressure rating than that of the housings 202 of the pumping modules 200 such that the pump housing 302 provides the structural support during operation to the pumping module housings 202. The pressure rating may refer to the operating or allowable internal pressure of the pump housing 302 and the pumping module housing 202 when used to contain or pump liquids or gases. The pressure rating may also be used to refer to the wall strength (dependent on factors such as wall thickness or material of the housing) of the pump housing 302 and the pumping module housing 202 and how much the walls may safely contain in normal operation. This may enable the pumping modules 200 to be manufactured without relying on each housing 200 to meet the overall pressure requirements for a pumping operation of the pump 300. Accordingly, the pumping module housing 202 may be manufactured to form a small gap or no gap between the exterior of the pumping module housing 202 and the interior of the pump housing 302 when the pumping modules 200 are positioned within the pump 300.

In one or more embodiments, a pumping module 200 in accordance with the present disclosure may be able to deliver or pump a fluid pressure between about 120-500 psi (827-3450 kPa). For example, a pumping module 200 may include one or more pumping stages (pairs of rotors and stators), in which each stage may deliver a fluid pressure between about 30-50 psi (207-345 kPa). As an example, a pumping module 200 may include four pumping stages, as shown in FIGS. 2 and 3, or up to ten pumping stages, in which the pumping module 200 may have a pumping capacity between about 120-500 psi. As such, in FIG. 5, each pumping module 200 may be able to increase the pumping pressure of the pump 300 by about 120-500 psi. As six pumping modules 200 are included in the pump 300 in FIG. 5, the pump 300 may have a pumping capacity up to about 3,000 psi (20700 kPa). The input fluid pressure may also be connected to both the input of the first module 200 and, through proper filtration, also connected to the outside area of the modules 200 but interior to the pump 300. Doing so, the modules 200 only need to have a pressure capacity rating of the pumping capability of the pump 300, such as shown here as an example to be 3000 psi.

In one or more embodiments, the pumping modules 200 may be positioned and sealed within the housing 302 of the pump 300 such that pressurized fluid may be positioned or flow between the exterior of the housings 202 of the pumping modules 200 and the interior of the housing 302 of the pump 300. For example, an annulus may be formed between an outer surface or exterior of the housings 202 of the pumping modules 200 and an inner surface or interior of the housing 302 of the pump 300. Pressurized fluid, such as the fluid flowing through the pumping modules 200, may also be able to enter into the annulus formed between the pumping modules 200 and the housing 302. For example, pumping fluid supplied through the pumping modules 200 may be separately provided or pumped into this annulus, or one or more ports may be formed through or between the pumping modules 200 to enable fluid to enter the annulus. This arrangement may minimize the pressure change across the housings 202 of the pumping modules 200 to also minimize the pressure capacity requirements for each of the housings 202.

Figure 6:
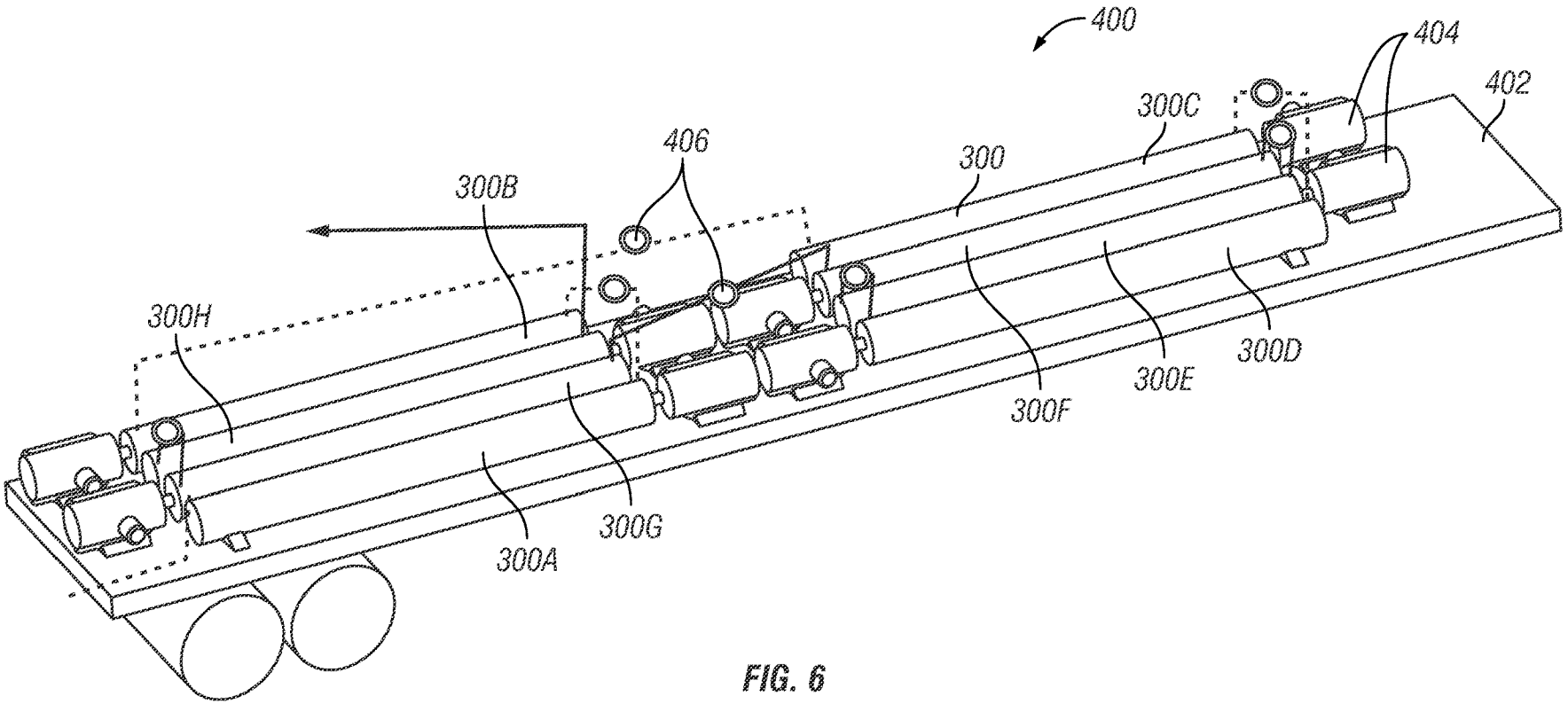
FIG. 6 depicts a perspective view of an example pumping system, according to one or more embodiments.

FIG. 6 depicts one or more embodiments of a pumping system 400 that may be used to pump fluid, such as into a wellbore. The pumping system 400 includes one or more pumps 300 positioned or arranged on a platform 402. The platform 402, for example, may be a trailer of a vehicle such that the platform 402 may be transported to and from a wellsite. One or more motors 404 may be included within the system 400 and coupled to the pumps 300, such as by having a motor 404 operably coupled to each pump 300, with each motor 404 also positioned on the platform 402. The motor 404 may be an electric motor, such as a 300 hp (224 kW) electric motor, or may be another type of motor or engine, such as a pneumatic or hydraulic motor. Further, a variable frequency drive and/or a gear box may be coupled between the motor 404 and the pump 300 to selectively vary and control the output from the motor 404 and to the pump 300.

The pumping system 400 may have the pumps 300 arrangeable or re-arrangeable such that the pumps 300 may be fluidly coupled or connected in parallel or in series with each other to pump fluid into a wellbore. For example, two or more of the pumps 300 may be arranged or connected in series with each other to form a series arrangement, may be arranged or connected in parallel with each other to form a parallel arrangement, or may have a combination of the two arrangements.

In one or more embodiments, a series arrangement for the pumps 300 may enable the system 400 to pump fluid at a higher pressure and a lower flow rate than in the parallel arrangement. As an example of a series arrangement, fluid may be received by and pumped into and out of a first pump 300A, received by and pumped into and out of a second pump 300B, and follow along accordingly, such as up to an eighth pump 300H. Assuming that each pump 300 has pumping capacity up to about 2,000 psi (13,800 kPa), the system 400 may have a pumping pressure capacity up to about 16,000 psi (110,300 kPa). This series arrangement would maintain a consistent flow rate through each pump 300 of the system 400.

As an example of a parallel arrangement, fluid may be received concurrently by each pump 300A-H. In such an arrangement, the pumping pressure capacity of the system 400 may be the same as each pump individually, but the flow rate through the system 400 would increase, such as by about eight times, assuming each pump 300 shown in FIG. 6 was coupled in parallel with each other. Alternatively, in other embodiments, the pumps 300A-H within the system 400 may be arranged in combinations of series and parallel arrangements, such as depending on the requirements for a pumping operation. One or more taps 406 may be included within the system 400, such as between the pumps 300, to selectively have fluid, fluid pressure, and/or flow rate removed from or added to the pumping system 400. Further, the pumps 300 within the pumping system 400 may be selectively turned off and on as needed. Accordingly, the system 400 may be modular to deliver fluids (e.g., fracturing fluid or cement) to a wellbore to meet the requirements for a pumping operation, such as in a fracturing or cementing operation. Furthermore, as the system 400 includes pumps 300 that incorporate the use of modular components and may be replaceable, the system 400 and pumps 300 may be used to pump fluids that are difficult to pump and damaging that would be damaging to other components (e.g., valves and pumps) not included in the system 400.

In addition to the embodiments described above, many examples of specific combinations are within the scope of the disclosure, some of which are detailed below:

Embodiment 1

A pumping module positionable within a pump housing for pumping fluid, comprising:

a cylindrical housing comprising an inlet end and an outlet end;

an inlet cap positioned on the inlet end of the cylindrical housing and comprising an inlet formed through the inlet cap;

an outlet cap positioned on the outlet end of the cylindrical housing and comprising an outlet formed through the outlet cap;

a shaft rotatable with respect to the cylindrical housing; and a rotor positioned within the cylindrical housing and rotatable by the shaft to push fluid through the cylindrical housing.

Embodiment 2

The pumping module of Embodiment 1, further comprising a stator positioned within the cylindrical housing with the rotor rotatable with respect to the stator to push fluid through channels of the rotor and stator as the rotor rotates with respect to the stator.

Embodiment 3

The pumping module of Embodiment 2, further comprising a plurality of rotors and a plurality of stators, each rotor paired with a corresponding stator such that each rotor and stator pair form a stage within the cylindrical housing.

Embodiment 4

The pumping module of Embodiment 2, wherein either one or both of the inlet cap and the outlet cap is removable from the cylindrical housing such that the rotor and stator are insertable into the cylindrical housing.

Embodiment 5

The pumping module of Embodiment 1, wherein either one of the inlet cap or the outlet cap is integrally formed with the cylindrical housing.

Embodiment 6

The pumping module of Embodiment 1, further comprising a seal positioned on either or both of the inlet cap about the inlet and the outlet cap about the outlet.

Embodiment 7

The pumping module of Embodiment 1, wherein the shaft is positioned within and at least partially extends through the cylindrical housing along an axis of the cylindrical housing.

Embodiment 8

The pumping module of Embodiment 7, wherein the rotor is magnetically coupled to the shaft.

Embodiment 9

A pump for pumping fluid, comprising:

an outer housing comprising an inlet end and an outlet end;

a plurality of pumping modules positionable within the outer housing, each comprising:

a cylindrical housing comprising an inlet end and an outlet end;

a stator positioned within the cylindrical housing; and a rotor positioned within the cylindrical housing and rotatable with respect to the stator to push fluid through the cylindrical housing; and the outer housing comprising a pressure rating higher than that of the cylindrical housings of the pumping modules.

Embodiment 10

The pump of Embodiment 9, further comprising a shaft rotatable with respect to the outer housing to rotate the rotors, wherein each pumping module further comprises:

an inlet cap positioned on the inlet end of the cylindrical housing and comprising an inlet formed through the inlet cap; and an outlet cap positioned on the outlet end of the cylindrical housing and comprising an outlet formed through the outlet cap.

Embodiment 11

The pump of Embodiment 10, wherein each pumping module further comprises a shaft at least partially extending through each cylindrical housing with the shafts of each pumping module coupled to each other to rotate in unison.

Embodiment 12

The pump of Embodiment 11, wherein the rotors are magnetically coupled to the shafts within each pumping module.

Embodiment 13

The pump of Embodiment 10, wherein either one or both of the inlet cap and the outlet cap of each pumping module is removable from the cylindrical housing such that the rotor and stator are insertable into the cylindrical housing.

Embodiment 14

The pump of Embodiment 10, wherein an annulus is formed between an interior of the outer housing and an exterior of the cylindrical housings of the pumping modules such that pressurized fluid is receivable in the annulus.

Embodiment 15

The pump of Embodiment 10, wherein each pumping module further comprises a seal positioned on at least one of the inlet cap about the inlet and the outlet cap about the outlet to form a seal against adjacent pumping modules, and wherein the inlet end is fluidly connected with the inlet end of one of the pumping modules.

Embodiment 16

The pump of Embodiment 9, wherein each pumping module further comprises a plurality of rotors and a plurality of stators, each rotor paired with a corresponding stator such that each rotor and stator pair form a stage within each cylindrical housing.

Embodiment 17

The pump of Embodiment 9, further comprising:

a platform;

a plurality of outer housings arranged on a platform, each outer housing comprising a plurality of pumping modules positionable within the outer housing to define a plurality of pumps;

wherein the plurality of pumps are configurable to pump fluid into a wellbore in a series arrangement and in a parallel arrangement; and wherein the plurality of pumps pump fluid into the wellbore at a higher pressure and a lower flow rate in the series arrangement than in the parallel arrangement.

Embodiment 18

A method of pumping fluid into a wellbore, comprising:

arranging pumps into a series arrangement;

pumping fluid into the wellbore with the pumps;

arranging the pumps into a parallel arrangement;

pumping fluid into the wellbore with the pumps in the parallel arrangement.

Embodiment 19

The method of Embodiment 18, wherein the pumps pump fluid into the wellbore at a higher pressure and a lower flow rate in the series arrangement than in the parallel arrangement.

Embodiment 20

The method of Embodiment 18, further comprising:

inserting pumping modules, each comprising a cylindrical housing, into outer housings to form the pumps, the outer housings comprising pressure ratings higher than the cylindrical housings; and coupling a motor to each of the pumps.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A pump for pumping fluid, comprising: an outer housing comprising an inlet end and an outlet end; and pumping modules positionable within the outer housing, each comprising: a cylindrical housing comprising an inlet end and an outlet end; a stator positioned within the cylindrical housing; a rotor positioned within the cylindrical housing and rotatable with respect to the stator to push fluid through the cylindrical housing; wherein the pumping modules are placed in the outer housing in series and operable to pump at least some of the fluid through the pump; wherein an annulus is formed between an interior of the outer housing and an exterior of the cylindrical housings and extending from the housing inlet end to the housing outlet end such that at least some of the fluid may flow into and pressurize the annulus; and wherein the outer housing is configured to withstand a pressure at least as high as that of a pressure of the fluid in the annulus.

2. The pump of claim 1, further comprising a shaft rotatable with respect to the outer housing to rotate the rotors, wherein each pumping module further comprises:

an inlet cap positioned on the inlet end of the cylindrical housing and comprising an inlet formed through the inlet cap; and an outlet cap positioned on the outlet end of the cylindrical housing and comprising an outlet formed through the outlet cap.

3. The pump of claim 2, wherein the shaft comprises multiple segments coupled to each other to rotate in unison, each pumping module comprising at least one of the shaft segments.

4. The pump of claim 3, wherein the rotors of at least one of the pumping modules are magnetically coupled to the shaft in the pumping module with magnets in at least one of the rotors or the shaft.

5. The pump of claim 2, wherein either one or both of the inlet cap and the outlet cap of each pumping module is removable from the cylindrical housing such that the rotor and stator are insertable into the cylindrical housing.

6. The pump of claim 2, wherein each pumping module further comprises a seal positioned on at least one of the inlet cap about the inlet or the outlet cap about the outlet to form a seal against an adjacent pumping module, and wherein the outer housing inlet end is fluidly connected with the inlet cap inlet of one of the pumping modules.

7. The pump of claim 1, wherein each pumping module further comprises more than one of the rotor and more than one of the stator, each of the rotors paired with one of the stators such that each pair form a stage within each cylindrical housing.

8. The pump of claim 1, further comprising:

more than one outer housing, each of the outer housings comprising pumping modules to define more than one of the pumps; and wherein the pumps are configurable to pump fluid in at least one of a series arrangement or a parallel arrangement.

9. A method of pumping fluid into a wellbore, comprising:

arranging pumps into at least one of a series arrangement or a parallel arrangement, each pump comprising: an outer housing comprising an inlet end and an outlet end; and pumping modules positionable within the outer housing, each comprising: a cylindrical housing comprising an inlet end and an outlet end, a stator positioned within the cylindrical housing, a rotor positioned within the cylindrical housing and rotatable with respect to the stator to push fluid through the cylindrical housing; wherein the pumping modules are placed in the outer housing in series and operable to pump at least some of the fluid through the pump; wherein an annulus is formed between an interior of the outer housing and an exterior of the cylindrical housings and extending from the housing inlet end to the housing outlet end such that at least some of the fluid may flow into and pressurize the annulus; and wherein the outer housing is configured to withstand a pressure at least as high as that of a pressure of the fluid in the annulus pumping fluid into the wellbore with the pumps.

10. The method of claim 9, wherein the pumps pump fluid into the wellbore at a higher pressure and a lower flow rate in the series arrangement than in the parallel arrangement.

11. The method of claim 9, further comprising coupling a motor to each of the pumps.

* * * * *